US008717153B2

(12) United States Patent
Kang et al.

(10) Patent No.: US 8,717,153 B2
(45) Date of Patent: May 6, 2014

(54) HAPTIC SCROLL WHEEL SWITCH FOR VEHICLE

(75) Inventors: Sung Hyun Kang, Gyeonggi-do (KR); Hanum Min, Gyeonggi-do (KR); Kyu Hwan Lee, Gyeonggi-do (KR)

(73) Assignees: Hyundai Motor Company, Seoul (KR); Kia Motors Corporation, Seoul (KR); Daesung Electric Co., Ltd., Ansan, Gyeonggi-Do (KR)

( * ) Notice: Subject to any disclaimer, the term of this patent is extended or adjusted under 35 U.S.C. 154(b) by 293 days.

(21) Appl. No.: 13/173,712

(22) Filed: Jun. 30, 2011

(65) Prior Publication Data

US 2012/0133495 A1 May 31, 2012

(30) Foreign Application Priority Data

Nov. 26, 2010 (KR) ..... 10-2010-0119191

(51) Int. Cl.
*G08B 6/00* (2006.01)

(52) U.S. Cl.
USPC ..... 340/407.2; 340/407.1; 345/156; 345/157

(58) Field of Classification Search
USPC ..... 340/407.2, 407.1; 345/156–159; 74/25, 74/552; 307/10.1
See application file for complete search history.

(56) References Cited

U.S. PATENT DOCUMENTS

| | | | | |
|---|---|---|---|---|
| 4,873,888 | A * | 10/1989 | Matsuyama | 74/573.1 |
| 7,499,023 | B2 | 3/2009 | Onodera | |
| 2009/0207035 | A1 * | 8/2009 | Watanabe et al. | 340/657 |
| 2010/0288072 | A1 * | 11/2010 | Springer et al. | 74/552 |

FOREIGN PATENT DOCUMENTS

| | | |
|---|---|---|
| KR | 10-0656002 | 12/2006 |
| KR | 10-2009-0084945 | 8/2009 |
| KR | 10-2009-0122778 | 12/2009 |

* cited by examiner

*Primary Examiner* — Steven Lim
*Assistant Examiner* — Hongmin Fan
(74) *Attorney, Agent, or Firm* — Edwards Wildman Palmer LLP; Peter F. Corless

(57) ABSTRACT

The present invention relates to a haptic scroll wheel switch for a vehicle which includes a haptic wheel holder, a haptic wheel, a motor, and an encoder slit. The haptic wheel is rotatably installed in the haptic wheel holder and has a bevel gear unit formed on its one side. The motor is installed in the haptic wheel holder and has a driving shaft and an encoder slit installed on its both ends. More specifically, the driving shaft and the encoder slit are rotated and driven while operating in conjunction with the motor. Furthermore, a pinion gear is fixed to the driving shaft of the motor and geared with the bevel gear of the haptic wheel so that the pinion gear is operated in conjunction with the bevel gear, and a printed circuit board is used in conjunction with a sensor for detecting a rotation of the encoder slit.

6 Claims, 3 Drawing Sheets

HAPTIC SCROLL WHEEL SWITCH FOR VEHICLE

CROSS-REFERENCE TO RELATED APPLICATION

Priority to Korean patent application number 10-2010-0119191, filed on Nov. 26, 2010, which is incorporated herein by reference in its entirety, is claimed

BACKGROUND OF THE INVENTION

1. Field of the Invention

The present invention relates to a haptic scroll wheel switch for a vehicle and, more particularly, to a haptic scroll wheel switch for a vehicle which enables rapid and safe operation of a switch by simplifying various switches installed in the consol of a vehicle using the haptic scroll wheel switch.

2. Background of the Invention

In general, haptics is a tactile feedback technology that takes advantage of a user's sense of touch by applying forces, vibrations, and/or motions to the user. This mechanical stimulation may be used to assist in the creation of virtual objects (objects existing only in a computer simulation), for control of such virtual objects, and for the enhancement of the remote control of machines and devices. Although haptic devices are capable of measuring bulk or reactive forces that are applied by the user, it should not be confused with touch or tactile sensors that measure the pressure or force exerted by the user to the interface like those used on a touch screen device.

Conventionally, the transfer of information was chiefly performed through the sense of sight or sound. However, research into haptics and the release of haptics application products are being widely performed owing to increased user needs for other types of sense information according to the development of a computer interface or a virtual environment in automobiles in particularly.

As years go on, the number of switches in a vehicle have increased because several convenience functions which are now being provided to a driver or a passenger. Because of the number of switches, drivers often feel overwhelmed while driving and thus become distracted while driving trying to operate these switches, thereby degrading the level of safety while driving.

Accordingly, there is a strong need for an integrated switch which replaces the large number of currently existing switches/buttons/operating mechanisms by integrating the functions of the switches in to fewer or even one switch and enable the rapid operation of the switch.

BRIEF SUMMARY OF THE INVENTION

An embodiment of the invention is directed to providing a haptic scroll wheel switch for a vehicle, which simplifies a switch and enables the rapid and safe operation of the switch by integrating various switches installed in a vehicle into the haptic scroll wheel switch, thereby helping to prevent the driver from becoming distracted and improving driver safety.

According to an embodiment of the present invention, a haptic scroll wheel switch for a vehicle includes a haptic wheel holder installed within the interior of the vehicle; a haptic wheel rotatably installed in the haptic wheel holder and configured to have a bevel gear unit formed on its one side; a motor installed in the haptic wheel holder and configured to have a driving shaft and an encoder slit installed on its both ends, the driving shaft and the encoder slit being rotated and driven while operating in conjunction with the motor; a pinion gear fixed to the driving shaft of the motor and geared with the bevel gear of the haptic wheel so that the pinion gear is operated in conjunction with the bevel gear; and a printed circuit board configured to have a sensor for detecting a rotation of the encoder slit.

Furthermore, the haptic wheel further may also include a wheel body installed within the haptic wheel to support the haptic wheel and configured to have the bevel gear unit formed in its one face. In addition, a scroll wheel may be formed to have a scroll pin which is configured to penetrate the wheel body and rotatably couple to the haptic wheel holder. Bearings may also be installed between the wheel body and the haptic wheel holder.

These bearings may include first and second bearings respectively installed on both sides of the wheel body. The first bearing supports the wheel body so that the wheel body does not deviate from a right position, and the second bearing supports the scroll wheel penetrating the wheel body. Support protrusions may be formed in one face of the second bearing and would be configured to come into a point contact with the scroll wheel.

Illustratively, a damper guide may be installed in the driving shaft of the motor to absorb the deformation and rolling of the driving shaft when the pinion gear is rotated.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
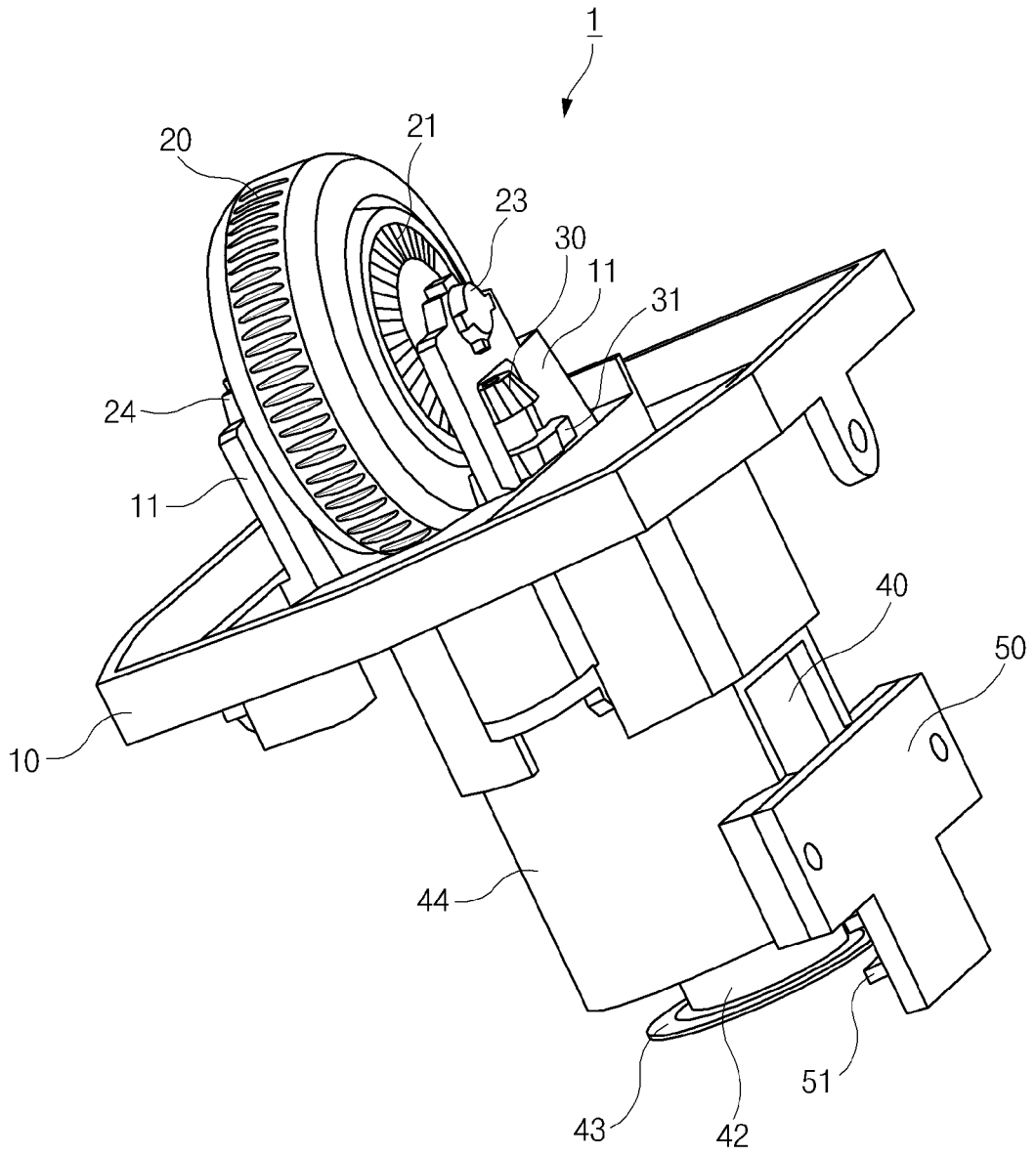
FIG. 1 is a diagram showing a haptic scroll wheel switch for a vehicle according to an exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DESCRIPTION OF EMBODIMENT

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

An embodiment of the present invention will now be described in detail with reference to the accompanying drawings.

Figure 2:
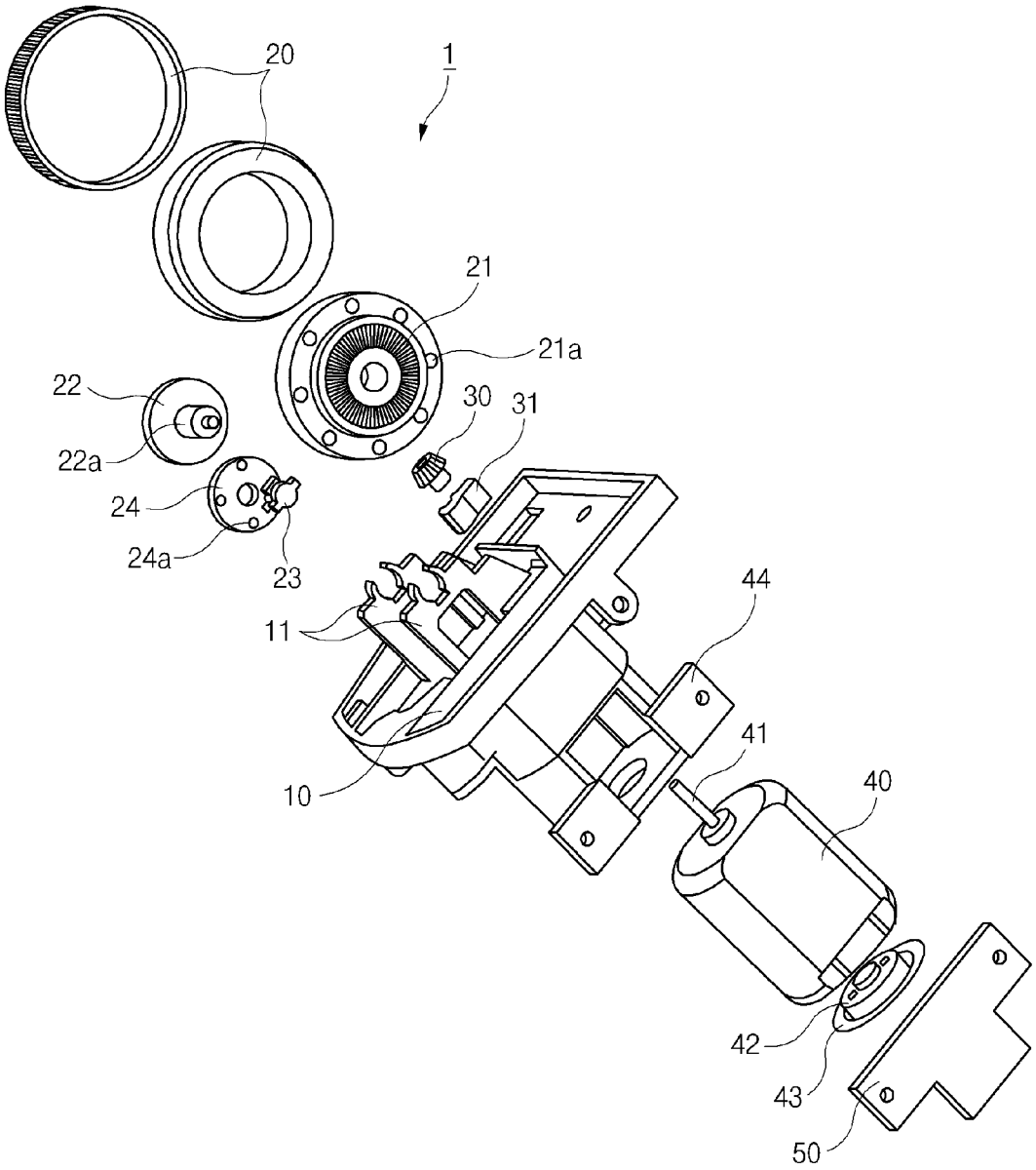
FIG. 2 is an exploded view of the haptic scroll wheel switch for a vehicle according to the exemplary embodiment of the present invention.
Figure 3:
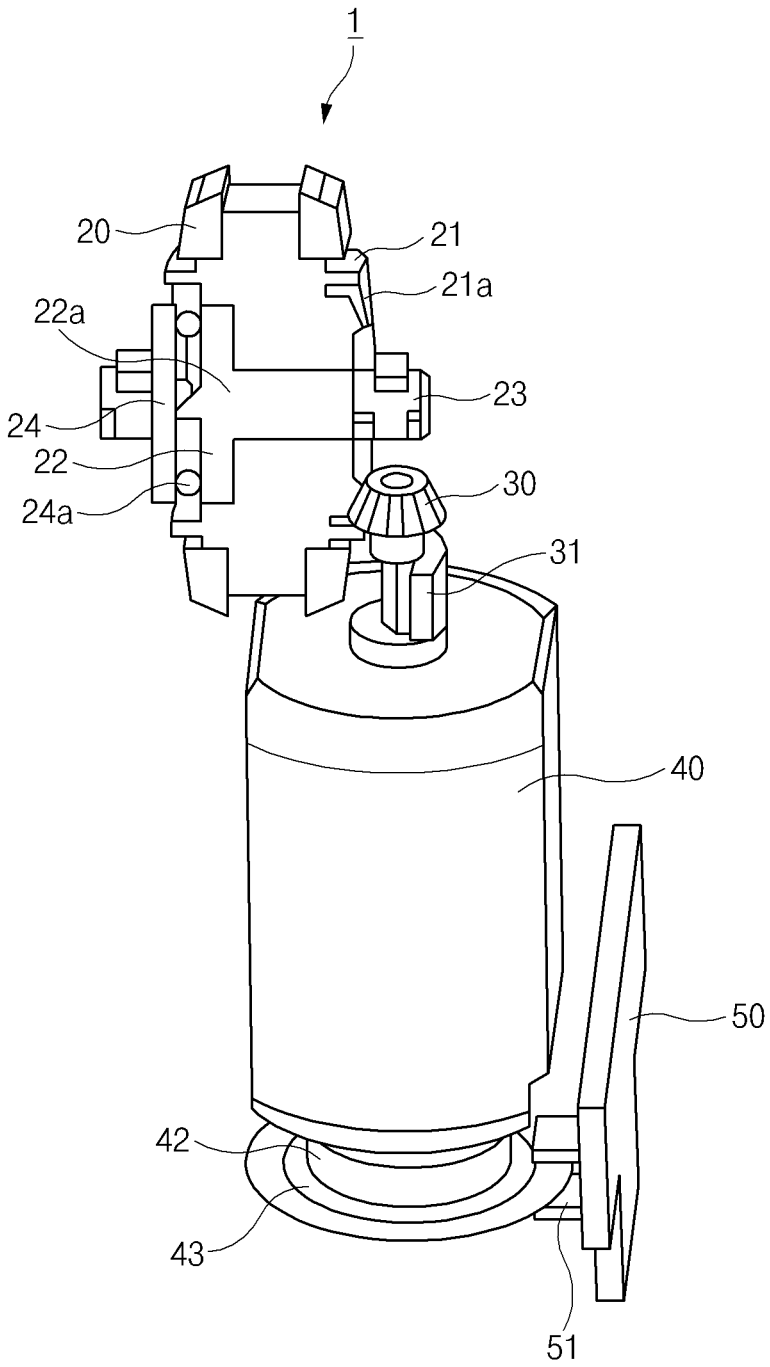
FIG. 3 is a cross-sectional view of the haptic scroll wheel switch for a vehicle according to the exemplary embodiment of the present invention.

FIGS. 1 to 3 are diagrams showing a haptic scroll wheel switch for a vehicle according to an illustrative embodiment of the present invention.

The haptic scroll wheel switch 1 for a vehicle according to the present invention, as shown, includes a haptic wheel holder 10, a haptic wheel 20, a motor 40, a printed circuit board 50, and so on.

The haptic wheel holder 10 in the illustrative embodiment of the present invention is installed in and fixed to the interior of a vehicle. Illustratively, the haptic wheel holder 10 may be installed in a place where a driver can easily operate the haptic wheel holder 10, such as a typical instrument panel, a consol, or a steering wheel installed in the interior of a vehicle.

A plurality of supports 11 may be installed on the top (that is, a portion exposed within an interior of a vehicle) of the haptic wheel holder 10 installed as described above and protruding therefrom. The haptic wheel 20 (to be described later) is rotatably installed on top ends of both the supports 11.

The haptic wheel 20, as shown in FIGS. 1 and 2, is rotatably installed in the supports 11 of the haptic wheel holder 10. The outer circumferential face of the haptic wheel 20 is wrinkled or grooved so that the haptic wheel 20 can be easily rotated. This wrinkle/or groove shape may be formed of irregularities or knurling in the material used to make the haptic wheel 20.

Furthermore, a wheel body 21 is illustratively installed within the haptic wheel 20 (that is the haptic wheel 20 surrounds the wheel body 21) and is configured to support the haptic wheel 20 and rotate in conjunction with the haptic wheel 20. A scroll wheel 22 is also illustratively installed in one face or (side of the circular body) of the wheel body 21. The scroll wheel 22 makes the wheel body 21 rotate in the haptic wheel holder 10. A scroll pin 22*a* is installed in the scroll wheel 22 and projected therefrom to penetrate the wheel body 21 and rotatably couple to the top ends of the supports 11 of the haptic wheel holder 10. The wheel body 21 and the haptic wheel 20 can accordingly be rotated on the supports 11 of the haptic wheel holder 10 by means of the scroll pin 22*a*.

Furthermore, a bevel gear unit 21*a* is formed in one face (side) of the wheel body 21 and is projected along the axi-cylindrical direction of the wheel body 21. The bevel gear unit 21*a* is geared with a pinion gear 30 to be described later and is operated in conjunction therewith.

Furthermore, bearings 23 and 24 are installed on both ends of the scroll pin 22*a* rotatably coupled to the supports 11 of the haptic wheel holder 10, thus supplying a smooth rotation of the scroll pin 22*a*, the scroll wheel 22, and the wheel body 21. Here, the scroll wheel 22 may be rotated and operated in conjunction with the wheel body 21, or in other embodiments may not be operated in conjunction with the wheel body 21, but rather only the wheel body 21 may be rotated.

The bearings 23 and 24, as shown in FIGS. 2 and 3, include first and second bearing members 23 and 24 respectively installed on both sides of the wheel body 21. The first and the second bearing members 23 and 24 support the wheel body 21 so that the wheel body 21 can rotate on the supports 11 of the haptic wheel holder 10 without deviating from a right position.

In particular, the first bearing member 23 has a smaller diameter than the second bearing member 24. Thus, it is preferred that the first bearing member 23 supports one face of the wheel body 21 having the bevel gear unit 21*a* formed therein and the second bearing member 24 supports the other face of the wheel body 21 on the opposite side of the bevel gear unit 21*a*.

The second bearing member 24 installed as described above supports the scroll wheel 22 penetrating the wheel body 21. A plurality of support protrusions 24*a* are formed at specific intervals in one face of the second bearing member 24 opposite the scroll wheel 22 and is configured to be in point contact with the scroll wheel 22.

Accordingly, the support protrusions 24*a* of the second bearing member 24 can absorb the shock of the haptic wheel 20 by absorbing rolling which may be generated when the haptic wheel 20 is rotated, with the support protrusions 24*a* coming into a point contact with the scroll wheel 22. Furthermore, the haptic wheel 20 can be rotated softly and smoothly because friction on the face is minimized by the point contact.

Meanwhile, the pinion gear 30 is rotatably installed in the supports 11 of the haptic wheel holder 10. The pinion gear 30, as described above, is geared with the bevel gear unit 21*a* of the wheel body 21 which is rotated along with the haptic wheel 20.

Furthermore, the pinion gear 30 is coupled to the motor 40 in such a way as to operate in conjunction with the motor 40. The motor 40 is embedded in a motor casing 44 disposed under the haptic wheel holder 10.

A driving shaft 41 is formed at the top of the motor 40 installed as described above and is projected therefrom. The driving shaft 41 is rotated and driven when power is supplied to the motor 40. The driving shaft 41 of the motor 40 is formed to penetrate the motor casing 44 and the haptic wheel holder 10. The driving shaft 41 is coupled to the pinion gear 30 and is operated in conjunction therewith.

Furthermore, a damper guide 31 is inserted into the supports 11 of the haptic wheel holder 10 and fixed thereto under the pinion gear 30. The damper guide 31 functions to guide the driving shaft 41 of the motor 40. Since the deformation and rolling of the driving shaft 41 of the motor 40 is absorbed by the damper guide 31, the driving shaft 41 can transfer uniform torque continually at a constant position.

An encoder slit holder 42 is installed at the bottom of the motor 40 and is rotated and driven while operating in conjunction with the driving shaft 41. An encoder slit 43 is fixed to the encoder slit holder 42. The printed circuit board 50 is installed on the lower side of the motor casing 44 spaced apart from the encoder slit 43 and is configured to include a photo sensor 51 for sensing the rotation of the encoder slit 43.

The printed circuit board 50 controls the operation of the motor 40 by supplying power to the motor 40 and advantageously prevents erroneous detection which may be generated by hand shaking when the torque of the motor 40 is generated.

The operation of the haptic scroll wheel switch for a vehicle configured as described above according to the present invention is described below.

First, when power is supplied to the motor 40 through the printed circuit board 50, the driving shaft 41 of the motor 40 is rotated and driven. The driving shaft 41 of the motor 40 rotated and driven as described above is prevented from being deformed and rolled by the damper guide 31 fixed to the supports 11 of the haptic wheel holder 10. Accordingly, the driving shaft 41 can transfer uniform torque.

Furthermore, when the driving shaft 41 of the motor 40 is rotated as described above, the pinion gear 30 fixed to the top end of the driving shaft 41 and the encoder slit 43 at the bottom, together with the driving shaft 41, are rotated and driven. The amount of rotation of the motor 40 is detected by the photo sensor 51 for detecting the encoder slit 43, and thus the printed circuit board 50 provides a haptic feeling according to circumstances.

When the pinion gear 30 is rotated by the driving shaft 41 as described above, the wheel body 21 and the haptic wheel 20 geared therewith are rotated by the bevel gear unit 21*a* of the wheel body 21 which is geared with the pinion gear 30.

At this time, the pinion gear 30 increases the torque of the driving shaft 41 and transfers the increased torque to the bevel gear unit 21*a*, thereby rotating the wheel body 21 and the haptic wheel 20.

When a driver manually rotates the haptic wheel 20, electric power can be transferred first to the wheel body 21, then the bevel gear unit 21*a*, then the pinion gear 30, then the driving shaft 41 of the motor and then to the encoder slit 43.

Advantageously, the haptic scroll wheel switch 1 of the present invention allows a driver (or a user) to integrally control a lot of functions through a simple operation and sensibly perceive more things through haptic feedback, the number of buttons can be reduced, perception can be improved so that a driver's attention is not distracted while driving, and driver safety can also be improved.

The above embodiment of the present invention is illustrative and not limitative. Various alternatives and equivalents are possible. Other additions, subtractions, or modifications are obvious in view of the present disclosure and are intended to fall within the scope of the appended claims.

What is claimed is:

1. A haptic scroll wheel switch for a vehicle, comprising:

a haptic wheel holder installed within an interior of the vehicle;

a haptic wheel rotatably installed in the haptic wheel holder and configured to have a bevel gear unit formed on its one side;

a motor installed in the haptic wheel holder and configured to have a driving shaft and an encoder slit installed on its both ends, the driving shaft and the encoder slit being rotated and driven while operating in conjunction with the motor;

a pinion gear fixed to the driving shaft of the motor and geared with a bevel gear of the haptic wheel so that the pinion gear is operated in conjunction with the bevel gear; and a printed circuit board configured to have a sensor for detecting a rotation of the encoder slit, wherein the haptic wheel further comprises a wheel body installed within the haptic wheel to support the haptic wheel and configured to have the bevel gear unit formed in its one face; a scroll wheel formed to have a scroll pin configured to penetrate the wheel body and rotatably coupled to the haptic wheel holder; bearings installed between the wheel body and the haptic wheel holder;

wherein the bearings comprise first and second bearings respectively installed on both sides of the wheel body, the first bearing supports the wheel body so that the wheel body does not deviate from a right position, and the second bearing supports the scroll wheel penetrating the wheel body.

2. The haptic scroll wheel switch according to claim 1, further comprising support protrusions formed in one face of the second bearing and configured to come into a point contact with the scroll wheel.

3. The haptic scroll wheel switch according to claim 1, further comprising a damper guide installed in the driving shaft of the motor and configured to absorb a deformation and rolling of the driving shaft when the pinion gear is rotated.

4. A method, comprising:

supplying power to a motor to rotate a shaft of the motor wherein the driving shaft is prevented from being deformed and rolled by a damper guide fixed to a support of a haptic wheel holder to transfer uniform torque to a haptic wheel;

in response to rotating the shaft, rotating a pinion gear fixed to the top end of the shaft and an encoder slit attached to a bottom of the shaft;

detecting by a photo sensor the amount the encoder slit is moved; and based on the amount the encoder slit moves, providing, by a printed circuit board, a haptic feeling to the haptic wheel, wherein the haptic wheel has a wheel body installed within the haptic wheel to support the haptic wheel and has the bevel gear unit formed in its one face, a scroll wheel having a scroll pin penetrating the wheel body and rotatably coupled to the haptic wheel holder, and bearings installed between the wheel body and the haptic wheel holder;

supporting by a first bearing the wheel body so that the wheel body does not deviate from a right position, and supporting by a second bearing the scroll wheel penetrating the wheel body.

5. The method according to claim 4, further comprising coming come into a point contact with the scroll wheel by one or more support protrusions formed in one face of the second bearing.

6. The method of claim 4, further comprising absorbing by the damper guide deformation and rolling of the driving shaft when the pinion gear is rotated.

* * * * *